US006295309B1

(12) United States Patent
Benz et al.

(10) Patent No.: US 6,295,309 B1
(45) Date of Patent: Sep. 25, 2001

(54) VACUUM ARC REMELTING APPARATUS AND PROCESS

(75) Inventors: Mark Gilbert Benz, Burnt Hills; Michael Francis Henry, Niskayuna; William Thomas Carter, Jr., Galway; Bernard Patrick Bewlay, Schenectady, all of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/651,962

(22) Filed: Aug. 31, 2000

(51) Int. Cl.[7] ..... H05B 3/60
(52) U.S. Cl. ..... 373/42; 373/45; 373/72
(58) Field of Search ..... 373/42, 43, 44, 373/45, 46, 56, 57, 59, 72

(56) References Cited

U.S. PATENT DOCUMENTS

| | | | | |
|---|---|---|---|---|
| 4,450,570 | | 5/1984 | Weigartner et al. | 373/69 |
| 4,612,649 | * | 9/1986 | Griebel, III et al. | 373/45 |
| 5,373,429 | | 12/1994 | Kasurinen | 362/299 |
| 5,610,935 | * | 3/1997 | Auberger | 373/72 |
| 5,621,751 | | 4/1997 | Williamson et al. | 373/70 |
| 5,930,284 | | 7/1999 | Hysinger et al. | 373/50 |

* cited by examiner

*Primary Examiner*—Tu Ba Hoang
(74) *Attorney, Agent, or Firm*—Noreen C. Johnson; Douglas E. Stoner

(57) ABSTRACT

A VAR process is conducted in an apparatus characterized by a crucible wall that provides a stable shelf anchor. The VAR apparatus includes a furnace chamber, a consumable electrode formed of a material to be remelted within the furnace chamber and a crucible within the furnace chamber. The crucible has a wall that forms a vessel to collect melt material from the consumable electrode. At least part of the wall is textured to provide area for mechanical stabilization of the shelf as the underside of the shelf melts and the upperside of the shelf forms. In a vacuum arc remelting process, a consumable electrode is loaded into a furnace chamber above a cooled crucible having a textured wall that forms a vessel to collect melt material from the consumable electrode. The process includes striking a direct electric current between the electrode and a bottom of the crucible to cause melting of material from a tip of the electrode. Melt material is collected from the tip in the crucible. The melt material is cooled to form an ingot characterized by a shelf of solidified material forming adjacent the textured section of the crucible wall in advance of a lower boundary of solidifying material.

39 Claims, 5 Drawing Sheets

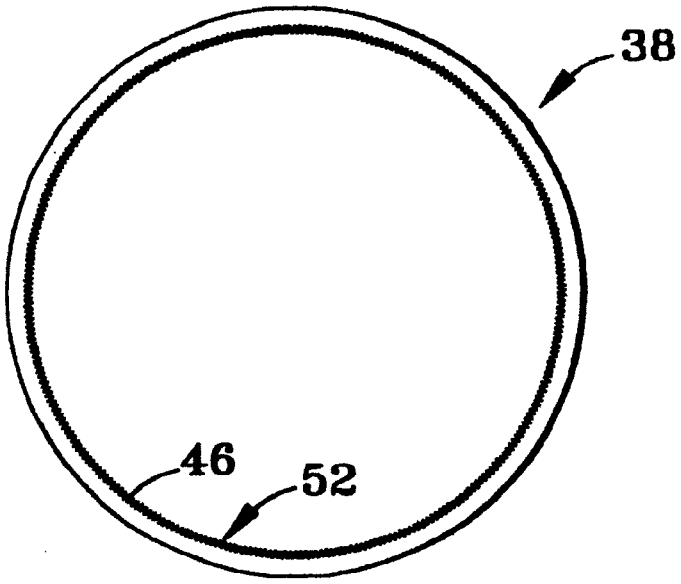
FIG. 6
FIG. 7
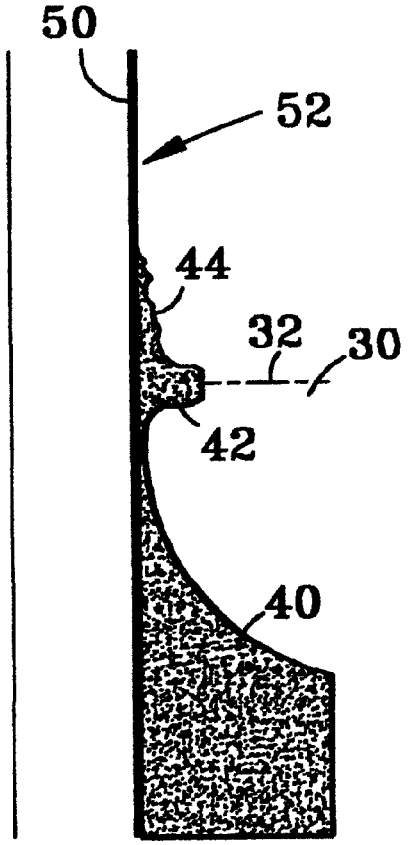

VACUUM ARC REMELTING APPARATUS AND PROCESS

BACKGROUND OF THE INVENTION

The present invention relates to a vacuum arc remelting ("VAR") apparatus and process.

VAR is a process for controlled solidification of segregation-sensitive alloys. In the process, a cylindrically shaped, alloy electrode is loaded into a water-cooled, copper crucible of a furnace. The furnace is evacuated and a dc electrical arc is struck between the electrode (cathode) and some start material at the bottom of the crucible (anode). The arc heats both the start material and the electrode tip, eventually melting both. As the electrode tip is melted away, molten metal drips into the crucible below. The process maintains a liquid melt pool that extends down to a mushy region, which is a transition zone to a fully solidified ingot. The crucible diameter is larger than the electrode diameter. Consequently, the ever-shrinking electrode can be translated downwards toward the anode pool surface to keep constant a mean distance between the electrode tip and the pool. The mean distance from the electrode tip to the liquid metal pool surface is called the electrode gap ($g_e$).

As cooling water extracts heat from the crucible wall, molten metal next to the wall solidifies. A solid layer of material solidifying against the crucible wall near the pool surface is called a "shelf." At some distance below the molten pool surface, material becomes completely solidified, yielding a fully dense alloy ingot. After a sufficient period of time has elapsed, a steady-state situation evolves, consisting of a shelfed "bowl" of molten material situated on top of a fully solidified ingot base.

VAR converts material electrodes into ingots having refined grain size and improved chemical and physical homogeneity. VAR is particularly suited to melting nickel-based "superalloys" (such as Alloy 718). These materials contain substantial quantities of reactive elements. VAR reduces contained gases, especially hydrogen and oxygen, non-metallic inclusions and center porosity and segregation. Mechanical properties of the remelted alloy, such as ductility and fatigue strength, are improved.

During the VAR process, volatile contaminate species such as manganese, aluminum and chromium evaporate. The vapor species of these elements condense on cold surfaces such as the area of a crucible wall immediately above the shelf of freezing material. Additionally as the electrode arc moves about the surface of the electrode, some particles splatter out of the melt pool and against the crucible wall where they can be trapped by the forming skin of the condensing vapor species.

As the shelf forms, high-melting-point solute-lean material is the first liquid metal to freeze against the condensed volatile species and splatter that covers the crucible wall. Additionally, as a melt proceeds, oxide and nitride inclusions present on the surface of the liquid metal pool are commonly pushed off to the sides of the melt pool and are frozen into solidified material at the shelf.

As the electrode melts off and liquid metal fills the crucible, the ingot shelf melts from the underside while a new shelf forms on the upperside. If a steady state of melting and shelf forming is maintained, then the shelf progressively forms and melts and progresses upward with the surface of the melt pool. So long as the steady state persists, the shelf acts as a barrier between the freezing melt splatter and condensing vapor species against the crucible wall. However if the steady state cannot be maintained, the shelf becomes unstable, breaks off and falls into the melt pool, dragging along vapor species skin, splatter and high-melting-point solute-lean material. The solute-lean material will appear in the ingot as a shiny "white spot." If the solute-lean material is accompanied by oxide species then the solute-lean material appears as a "dirty white spot." These areas of solute-lean material and oxide species are sites for early failure initiation, resulting in reduced life of parts made from the material.

There is a need for a VAR furnace and process that avoid contamination of the melt with areas of splatter and oxide species.

BRIEF SUMMARY OF THE INVENTION

The invention provides a VAR process and furnace that avoid contamination by stabilizing the ingot shelf to prevent abrupt fracture. The VAR process is conducted in an apparatus of new design characterized by a crucible wall that provides an anchor so that the shelf does not become unstable. The VAR apparatus comprises a furnace chamber, a consumable electrode formed of a material to be remelted within the furnace chamber and a crucible within the furnace chamber. The crucible comprises a wall that forms a vessel to collect melt material from the consumable electrode. The wall is textured to provide increased surface area to mechanically stabilize solidifying melt material.

A vacuum arc remelting process comprises loading a consumable electrode into a furnace chamber above a cooled crucible comprising a textured wall that forms a vessel to collect melt material from the consumable electrode. The process includes striking a direct electric current between the electrode and a bottom of the crucible to cause melting of material from a tip of the electrode. Melt material is collected from the tip in the crucible. The melt material is cooled to form an ingot characterized by a shelf of solidified material forming adjacent the textured wall of the crucible in advance of a lower boundary of solidifying material.

BRIEF DESCRIPTION OF THE DRAWINGS

FIG. 6 is a top schematic view of the full circumference of a crucible;

FIG. 7 is a schematic representation of a section of a textured furnace crucible wall and solidifying ingot;

DETAILED DESCRIPTION OF THE INVENTION

In accordance with the invention, a VAR crucible wall is textured to provide increased surface area for mechanical stabilization of the shelf as the underside of the shelf melts and the upperside of the shelf forms. A textured surface is an uneven or disturbed surface that provides an increased surface area over a plane surface. The surface may be grooved as shown or patterned or corrugated with alternating ridges and ribs. The surface may be characterized by flutes, pleats, impressions such as grooves or indents or the surface can be contoured with furrows, ripples or ridges.

These and other features will become apparent from the drawings and following detailed discussion, which by way of example without limitation describe preferred embodiments of the present invention.

Figure 1:
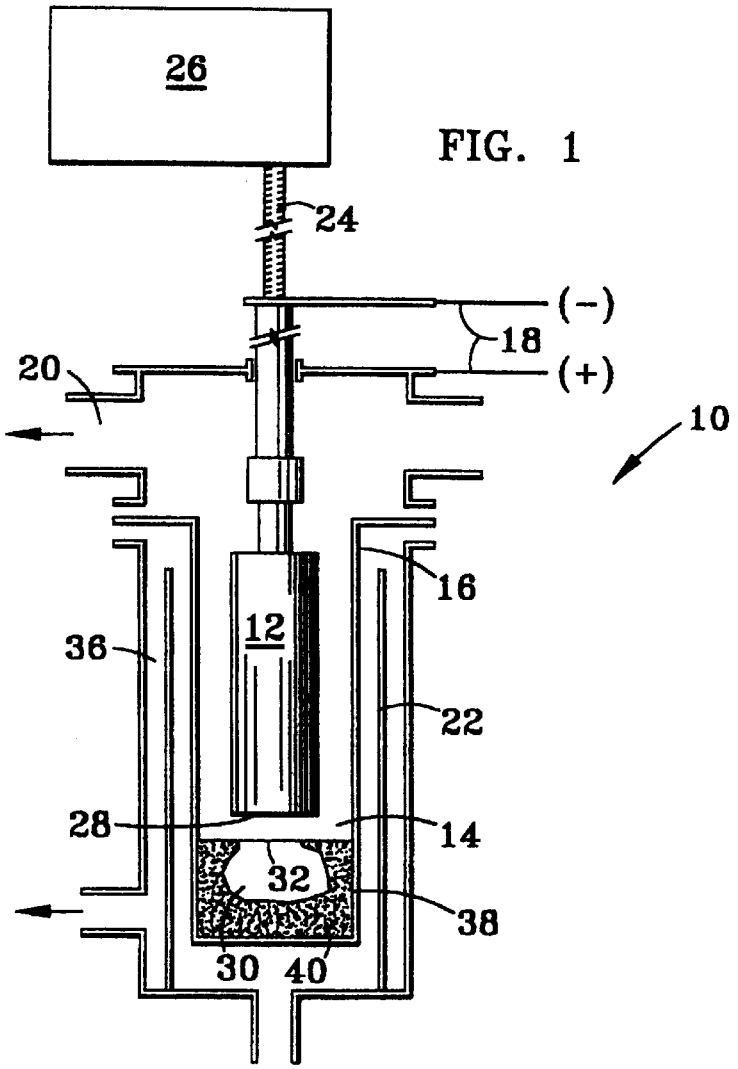
FIG. 1 is a schematic cut-away representation of a VAR furnace.
Figure 2:
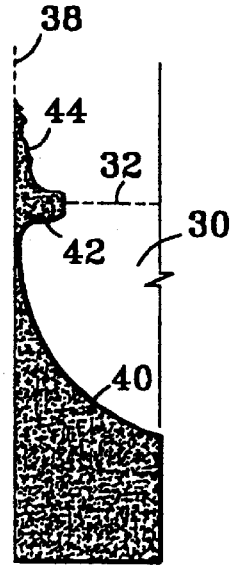
FIG. 2 is a schematic representation of a section of the furnace crucible wall and solidifying ingot.

FIG, 1 is a schematic cut-away representation of a VAR furnace 10 and FIG. 2 is a schematic representation of a section of the furnace crucible wall 381 showing a portion of a solidifying ingot. In FIGS. 1 and 2, a cylindrically shaped, alloy electrode 12 is loaded into the furnace chamber 14 above a water-cooled, copper crucible 16. The furnace 10 includes direct current source 18, vacuum port 20, cooling water guide 22, ram drive screw 24 and ram drive motor assembly 26.

Referring to FIG. 1 and FIG. 2, in operation, the furnace chamber 14 is evacuated and a direct current (dc) electrical arc is struck between the electrode (cathode) 12 and start material (e.g., metal chips) at the bottom (anode) of the crucible 16. An arc heats both the start material and electrode tip 28, eventually melting both. As the electrode tip 28 is melted away, molten metal drips off, forming a melt pool 30 beneath. Because the crucible diameter is typically 50–150 mm larger than the electrode diameter, the electrode 18 can be translated downward toward the anode pool to maintain a mean distance between the electrode tip 28 and pool surface 32.

As cooling water 36 extracts heat from crucible wall 38, molten metal next to the wall solidifies. At some distance below the molten pool surface, the alloy becomes completely solidified, yielding a fully dense ingot 40. After a period of time, a steady-state situation evolves characterized by a "bowl" of molten material situated on top of a fully solidified ingot base. The ingot 40 grows as more material solidifies.

As a melt proceeds, oxide and nitride inclusions present in the electrode float to the surface 32 of molten pool 30. The oxides and nitride species are commonly pushed off to the sides of the melt pool 30 and are frozen into solidified material at the shelf 42, which comprises solidified material at the melt interface directly below the melt pool surface 32. Directly above the shelf 42, splash and vapor species condensation forms a crusty ledge called the crown 44.

During the melt sequence, conditions can cause the shelf 42 or crown 44 to become detached from the crucible wall 38. The shelf 42 collapses and shelf material and crown material fall into the molten pool 30. The materials can sink into the molten pool, where the shelf material becomes remelted leaving the crown oxide and nitride material as clustered defects. Or if the shelf is large in mass, it may be only partially remelted so that it freezes with oxide or nitride species attached.

Figure 3:
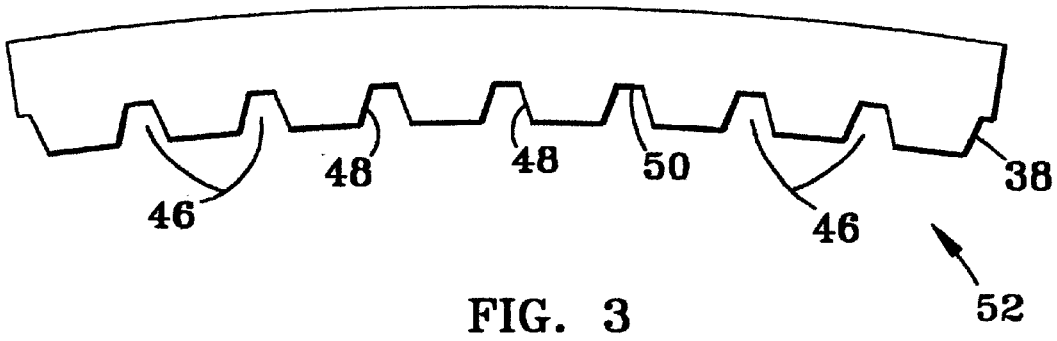
FIG. 3 is a schematic top view of a grooved crucible wall.
Figure 4:
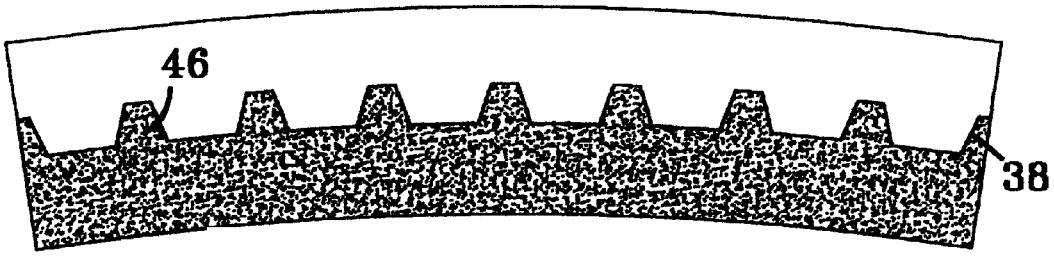
FIG. 4 is a schematic top view of the grooved crucible wall with a portion of solidifying ingot.
Figure 5:
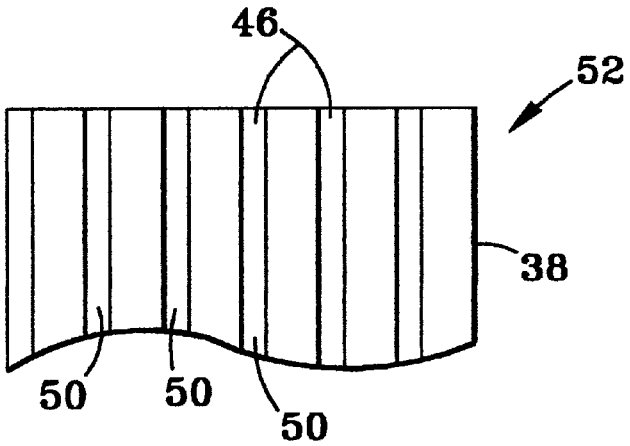
FIG. 5 is a schematic elevation of a portion of a grooved crucible wall.

FIGS. 3, 4, 5, 6 and 7 illustrate a crucible wall 38 provided with a textured surface 52 according to the invention. FIG. 3 is a schematic top view of a grooved crucible wall 38. FIG. 4 is a schematic representation of a section of the furnace crucible wall 38, textured crucible wall surface 52 and solidifying ingot 40. FIG. 5 is a schematic elevation of a portion of a grooved crucible wall 38. FIG.6 is a schematic top view of the full circumference of a crucible where the textured surface 52 is provided by vertical grooves 46. FIG. 7 is a schematic top view of a section of a crucible 16 where the textured surface 52 is provided by vertical grooves 46.

In the FIGS., the crucible wall 38 is textured such that a supporting ligament or series of supporting ligaments solidify between the shelf and the underlying ingot. The ligaments provide for mechanical stabilization of the shelf as the underside of the shelf melts and the upperside of the shelf forms. Textured freezing surface of the ingot that is complementary to the textured wall surface 52 supports and mechanically stabilizes the shelf. The textured surface 52 also increases heat extraction from the forming shelf because of increased contact area between the water-cooled copper and the liquid metal pool. Increased heat extraction increases the thickness of the shelf and strengthens and further stabilizes the shelf. The thicker, supported and more stable shelf resists abrupt fracture and consequent contamination of the freezing ingot.

Shown in FIGS. 3, 4, 5, 6 and 7 is crucible wall 38 with grooves 46, which comprise sloped side walls 48 and flattened bottoms 50 that impose into the otherwise planer crucible wall surface 52. The shape, depth and spacing of the grooves 46 are chosen such that they readily fill with liquid metal, solidify into ribs, and do not completely re-melt as the shelf 42 melts from the underside and forms on the upperside.

The grooves 46 can be angled outwardly from a vertical line perpendicular to the base of the groove and grove corners can be rounded to allow for ease of groove fill and ease of ingot withdrawal from the crucible after solidifying the ingot. The grooves 46 can be angled at up to about 60° from the vertical and desirably from about 5 to 30 degrees from vertical. Preferably, the grooves 46 can be angled from about 10 to 20 degrees from vertical.

For any texture configuration, sharp comers can be rounded to provide for ease of ingot withdrawal and to prevent sharp comers on the resulting ingot. A measure of rounding can be described by the radius of the round comer measured from inside the arc of rounding. A wide range of radii for comer rounding is acceptable, up to ½ times groove width, desirably from about ⅛ to ½ times the groove and preferably from about ¼ to ½ times the groove width.

The groove shape can vary from rectangular to trapezoidal to semicircular. All shapes that fill readily and allow for withdraw of the ingot 40 from the crucible 16 after complete solidification of the ingot are acceptable. The groove depth can range from ⅛ to ¾ inch, with a preferred range from about ¼ to ½ inch. Typical groove widths can range from about ⅛ to 2 inches, with a preferred range from about ¼ to ½ inch. In most instances, the size of the groove will vary with the size of the crucible. Proportion of depth or width of grooves to crucible circumference can vary from about 0.001 to 0.05, desirably about 0.002 to 0.04 and preferably from about 0.006 to 0.02 and frequency of grooves per inch of inside circumference can vary from about 0.1 to 5, desirably about 0.3 to 4, and preferably 0.5 to 3.

FIGS. 3, 4, 5, 6 and 7 illustrate a preferred embodiment, wherein the crucible wall 38 is grooved with trapezoidal grooves 46. Other shapes varying from rectangular to semicircular can be used. For example, all shapes that fill readily and allow for withdraw of the ingot from the crucible after complete solidification of the ingot are acceptable.

Figure 8:
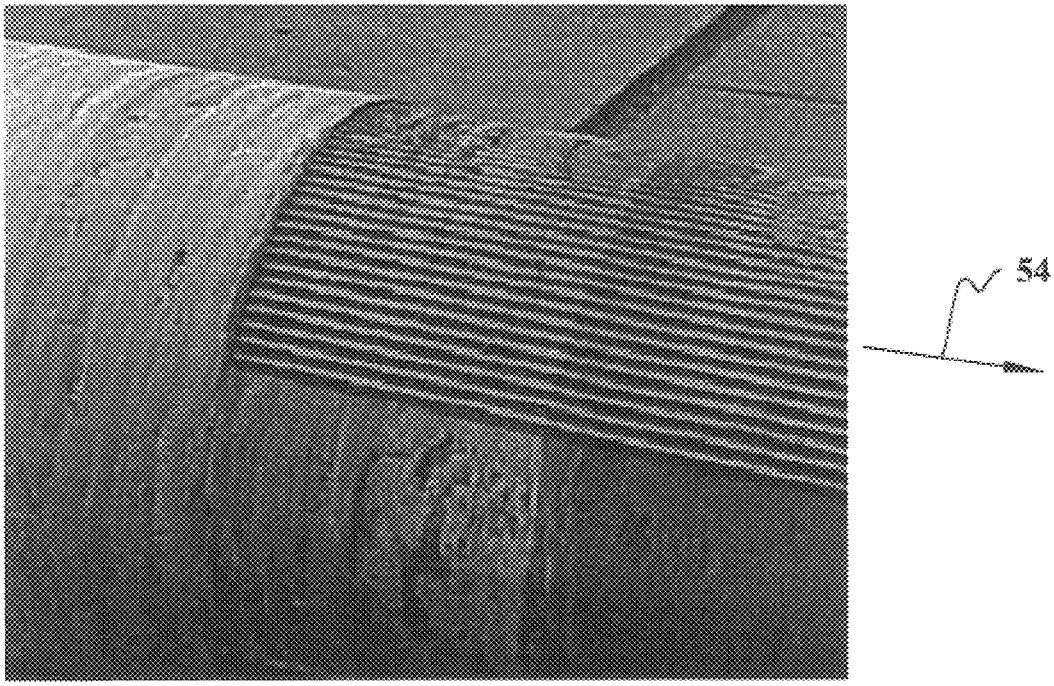
FIG. 8 is a photograph of the surface of an ingot with a test pattern of rib indentations.

These and other features will become apparent from FIG. 8 and the following detailed discussion, which by way of example without limitation describe a preferred embodiment of the present invention.

EXAMPLE

FIG. 8 is a photograph of a surface of an Alloy 718 (approximately Ni, 19% Cr, 18% Fe, 5% Nb, 3% Mo, 1% Ti, 0.6% Al) superalloy ingot solidified under standard commercial VAR melting conditions with a small test patch formed using a preferred version of the invention as an example. In this Example, an upper portion of a standard commercial-grade 20-inch diameter VAR crucible was modified to include two 90-degree arc textured wall test sections, separated by two 90-degree arc smooth-wall comparison sections.

The texture in the crucible wall was provided by a series of vertical grooves approximately ¼ inch deep by ¼ inch wide occurring at a spacing of one per ½ inch of inside circumference of the crucible wall. The depth and width were chosen such that the ribs that solidify within the grooves do not remelt as the liquid metal in the crucible rises. The frequency of position on the inside circumference was chosen to give rigid stabilization of the remelting shelf. The sidewall grooves were angled at approximately 14 degrees outward from a vertical line perpendicular to the base of the groove and grove comers were rounded to allow for ease of fill of the grooves with liquid metal and ease of ingot withdrawal from the crucible after solidifying the ingot.

The process was observed to produce a stabilized shelf during the molding process and the Alloy 718 casting shown in FIG. 8 was characterized by lessened white spots and dirty white spots as compared to an ingot molded in a furnace without a textured wall.

Figure 9:
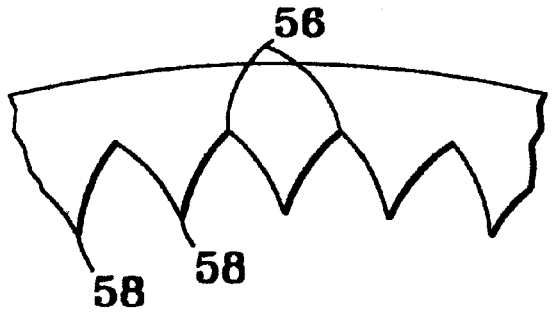
FIGS. 9, 10, 11 and 12 are schematic representations of alternative textured walls.
Figure 10:
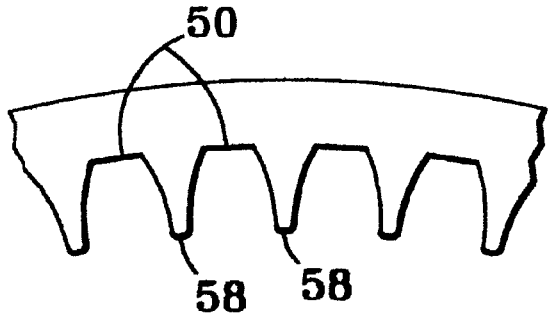
Figure 11:
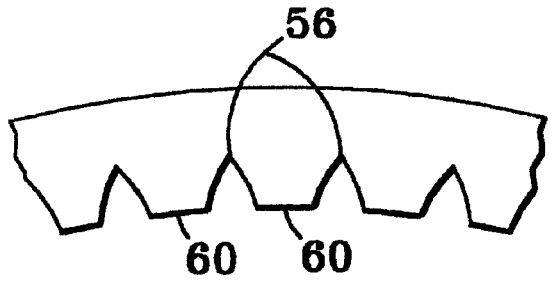
Figure 12:
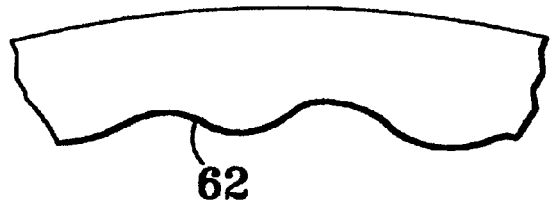

While preferred embodiments of the invention have been described, the present invention is capable of variation and modification and therefore should not be limited to the precise details of the Example. For example, the invention can be used in conjunction with a process to mold any suitable material such as a highly-alloyed iron base steel or a highly alloyed titanium such as Ti-17 (Ti, 5% Al, 4% Cr, 4% Mo, 2% Sn, 2% Zr). FIGS. 9, 10, 11 and 12 show further examples of textured wall surface 52. FIG. 9 shows a crevice 56 and peak 58 texture, FIG. 10 shows a peak 58 with flattened bottom 50, FIG. 11 shows flattened top 60 with crevice 56 and FIG. 12 shows another preferred structure comprising a rounded undulating topography 62. The invention includes all changes and alterations that fall within the purview of the following claims.

What is claimed is:

1. A vacuum arc remelting apparatus, comprising:

a furnace chamber;

a consumable electrode formed of a material to be remelted within said furnace chamber; and a crucible within said furnace chamber, said crucible comprising a wall that forms a vessel to collect melt material from said consumable electrode, wherein said wall is textured to provide increased surface area to mechanically stabilize solidifying melt material.

2. The apparatus of claim 1, wherein said textured wall provides anchoring of a shelf of said solidifying melt material.

3. The apparatus of claim 1, wherein said textured wall comprises an uneven or disturbed surface that provides an increased surface area over a plane surface.

4. The apparatus of claim 1, wherein said textured wall comprises a ribbed, patterned or corrugated surface with alternating ridges and grooves.

5. The apparatus of claim 1, wherein said textured wall comprises flutes, pleats, impressions, indents or grooves.

6. The apparatus of claim 1, wherein said textured wall is contoured with furrows, ripples or ridges.

7. The apparatus of claim 1, wherein said textured wall is contoured with substantially vertical grooves.

8. The apparatus of claim 1, wherein said textured wall is contoured with grooves angled less than 60° from vertical.

9. The apparatus of claim 1, wherein said textured wall is contoured with grooves angled about 10 to 20 degrees from vertical.

10. The apparatus of claim 1, wherein said textured wall is contoured with substantially vertical grooves having a groove depth of from about ⅛ to ¾ inch, a width of from about ⅛ to 2 inches and a groove spacing of from about ⅜ to 4 inches.

11. The apparatus of claim 1, wherein said textured wall is contoured with substantially vertical grooves having a groove depth of from about ¼ to ½ inch, a width of from about ¼ to ½ inch and a groove spacing from spacing from about ½ to ¾ inches.

12. The apparatus of claim 1, wherein said textured wall is contoured with substantially vertical grooves that are rounded up to about ½ times the groove width.

13. The apparatus of claim 1, wherein said textured wall is contoured with substantially vertical grooves that are rounded from about ¼ to ½ times groove width.

14. The apparatus of claim 1, wherein said textured wall is contoured with substantially vertical grooves and proportion of depth or width of grooves to crucible circumference is from about 0.001 to 0.05 and frequency of grooves per inch of inside crucible circumference is from about 0.1 to 5.

15. The apparatus of claim 1, wherein said textured wall is contoured with substantially vertical grooves and proportion of depth or width of grooves to crucible circumference is from about 0.002 to 0.04 and frequency of grooves per inch of inside crucible circumference is from about 0.3 to 4.

16. The apparatus of claim 1, wherein said textured wall is contoured with substantially vertical grooves and proportion of depth or width of grooves to crucible circumference is from about 0.006 to 0.02 and frequency of grooves per inch of inside crucible circumference is from about 0.5 to 3.

17. The apparatus of claim 1, wherein said textured wall comprises alternating crevices and peaks.

18. The apparatus of claim 1, wherein said textured wall comprises alternating flattened bottoms and peaks.

19. The apparatus of claim 1, wherein said textured wall comprises alternating flattened tops and crevices.

20. The apparatus of claim 1, wherein said textured wall comprises a rounded undulating topography.

21. A vacuum arc remelting process, comprising loading a consumable electrode into a furnace chamber above a cooled crucible comprising a textured wall that forms a vessel to collect melt material from said consumable electrode;

striking a direct electric current between said electrode and a bottom of said crucible to cause melting of material from a tip of said electrode;

collecting melt material from said tip in said crucible; and cooling said melt material to form an ingot characterized by a shelf of solidified material forming adjacent said textured wall of said crucible in advance of a lower boundary of solidifying material.

22. The process of claim 21, wherein said textured wall stabilizes said shelf to prevent abrupt dislodging of said shelf from said wall.

23. The process of claim 21, wherein said textured wall comprises an uneven or disturbed surface that provides an increased surface area over a plane surface.

24. The process of claim 21, wherein said textured wall is contoured with substantially vertical grooves.

25. The process of claim 21, wherein said textured wall is contoured with grooves angled less than 60° from vertical.

26. The process of claim 21, wherein said textured wall is contoured with grooves angled about 10 to 20 degrees from vertical.

27. The process of claim 21, wherein said textured wall is contoured with substantially vertical grooves having a groove depth of from about ⅛ to ¾ inch, a width of from about ⅛ to 2 inches and a groove spacing of from about ⅜ to 4 inches.

28. The process of claim 21, wherein said textured wall is contoured with substantially vertical grooves having a groove depth of from about ¼ to ½ inch, a width of from about ¼ to ½ inch and a groove spacing from about ½ to ¾ inches.

29. The process of claim 21, wherein said textured wall is contoured with substantially vertical grooves that are rounded up to about ½ times the groove width.

30. The process of claim 21, wherein said textured wall is contoured with substantially vertical grooves that are rounded from about ¼ to ½ times groove width.

31. The process of claim 21, wherein said textured wall comprises trapezoidal-shaped grooves at a frequency of a groove per about ⅜ inch to 4 inches of the inside crucible wall.

32. The process of claim 21, wherein said textured wall comprises trapezoidal-shaped grooves and proportion of depth or width of grooves to crucible circumference is from about 0.001 to 0.05 and frequency of grooves per inch of inside crucible circumference is from about 0.1 to 5.

33. The process of claim 21, wherein said textured wall comprises trapezoidal-shaped grooves and proportion of depth or width of grooves to crucible circumference is from about 0.002 to 0.04 and frequency of grooves per inch of inside crucible circumference is from about 0.3 to 4.

34. The process of claim 21, wherein said textured wall comprises trapezoidal-shaped grooves and proportion of depth or width of grooves to crucible circumference is from about 0.006 to 0.02 and frequency of grooves per inch of inside crucible circumference is from about 0.5 to 3.

35. The process of claim 21, wherein said textured wall comprises trapezoidal-shaped grooves at a frequency of a groove per about ½ inch to ¾ inch of the inside crucible wall.

36. The process of claim 21, wherein said textured wall comprises alternating crevices and peaks.

37. The process of claim 21, wherein said textured wall comprises alternating flattened bottoms and peaks.

38. The process of claim 21, wherein said textured wall comprises alternating flattened tops and crevices.

39. The process of claim 21, wherein said textured wall comprises a rounded undulating topography.

* * * * *